US010022036B2

(12) United States Patent
Boyd et al.

(10) Patent No.: US 10,022,036 B2
(45) Date of Patent: Jul. 17, 2018

(54) DISHWASHER WITH INTEGRATED LIGHTING

(71) Applicant: Whirlpool Corporation, Benton Harbor, MI (US)

(72) Inventors: Tod E. Boyd, Findlay, OH (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1118 days.

(21) Appl. No.: 14/221,643

(22) Filed: Mar. 21, 2014

(65) Prior Publication Data

US 2014/0338708 A1 Nov. 20, 2014

Related U.S. Application Data

(60) Provisional application No. 61/823,940, filed on May 16, 2013.

(51) Int. Cl.
*A47L 15/42* (2006.01)
*A47L 15/50* (2006.01)

(52) U.S. Cl.
CPC ..... *A47L 15/50* (2013.01); *A47L 15/4246* (2013.01); *A47L 15/4257* (2013.01); *A47L 15/4274* (2013.01); *A47L 15/502* (2013.01)

(58) Field of Classification Search
CPC ..... A47L 15/4246; A47L 15/4257; A47L 15/4274; A47L 15/50; A47L 15/502
USPC ..... 134/56 D, 57 D, 58 D, 113
See application file for complete search history.

(56) References Cited

U.S. PATENT DOCUMENTS

| | | | | |
|---|---|---|---|---|
| 5,836,669 | A | 11/1998 | Hed | |
| 2006/0089732 | A1* | 4/2006 | Range | A47L 15/4293 700/83 |
| 2009/0044846 | A1 | 2/2009 | Rosenbauer et al. | |
| 2011/0215689 | A1 | 9/2011 | Wegener et al. | |

FOREIGN PATENT DOCUMENTS

| | | | |
|---|---|---|---|
| DE | 102010015849 | B3 | 4/2011 |
| DE | 102011122897 | A1 | 3/2013 |
| EP | 2366323 | A1 | 9/2011 |
| EP | 2394557 | A2 | 12/2011 |
| EP | 2543307 | A1 | 1/2013 |
| EP | 2581026 | A2 | 4/2013 |

OTHER PUBLICATIONS

Rehm et al., "DE102011122897A1 English Machine Translation.pdf", Mar. 21, 2013—Machine translation from Espacenet.com.*
Sachon et al., "EP2581026A2 English Machine Translation.pdf", Apr. 17, 2013—Machine translation from Espacenet.com.*
European Search Report for Corresponding EP14164066.4, dated Oct. 6, 2014.

* cited by examiner

*Primary Examiner* — Levon J Shahinian
(74) *Attorney, Agent, or Firm* — McGarry Bair PC

(57) ABSTRACT

A dishwasher includes a tub at least partially defining a treating chamber for receiving dishes for treatment according to the cycle of operation and having an open face providing access to the treating chamber, a dish holder slidable relative to the tub through the open face between a loading position and a treating position and a light source provided on the dish holder for illuminating dishes contained in the dish holder.

14 Claims, 9 Drawing Sheets

DISHWASHER WITH INTEGRATED LIGHTING

CROSS-REFERENCE TO RELATED APPLICATION

This application claims the benefit of U.S. Provisional Application No. 61/823,940, filed May 16, 2013, which is incorporated herein by reference in its entirety.

BACKGROUND OF THE INVENTION

Automatic dishwashers may include a plurality of components that are collectively controlled by a controller to treat dishes within a treating chamber according to an automatic cycle of operation. Such dishwashers may include illumination systems for illuminating the interior of the tub.

SUMMARY

The invention relates to a dishwasher for treating dishes according to an automatic cycle of operation. In one aspect, the dishwasher includes a tub at least partially defining a treating chamber for receiving dishes for treatment according to the cycle of operation and having an open face providing access to the treating chamber, a dish holder slidable relative to the tub through the open face between a loading position and a treating position, a light source provided on the dish holder for illuminating dishes contained in the dish holder, and a power source coupled to the light source by an electrical conductor wherein the electrical conductor is provided with slack to enable the dish holder to move at least partially out of the treating chamber.

In another aspect, the dishwasher includes a tub at least partially defining a treating chamber for receiving dishes for treatment according to the cycle of operation and having an open face providing access to the treating chamber, a dish holder slidable relative to the tub through the open face between a loading position and a treating position, a rail system slidably coupling the dish holder to the tub for movement relative to the treating chamber, a light source provided on the dish holder for illuminating dishes contained in the dish holder, and a power source selectively coupled to the light source by a contact connection provided on the rail system where the contact connection is closed to couple the power source to the light source when the dish holder is slid at least partially out of the treating chamber.

In yet another aspect, the dishwasher includes a tub at least partially defining a treating chamber for receiving dishes for treatment according to the cycle of operation and having an open face providing access to the treating chamber, a dish holder slidable relative to the tub through the open face between a loading position and a treating position, and a light pipe integrally formed with the dish holder for illuminating dishes contained in the dish holder.

In yet another aspect, the dishwasher includes a tub at least partially defining a treating chamber for receiving dishes for treatment according to the cycle of operation and having an open face providing access to the treating chamber, a dish holder comprising a drawer slidable relative to the tub through the open face between a loading position and a treating position, and having an outer wall and an inner wall spaced from the outer wall to define a cavity, and a light source provided within the cavity for illuminating dishes contained in the dish holder.

In yet another aspect, the dishwasher includes a tub at least partially defining a treating chamber for receiving dishes for treatment according to the cycle of operation and having an open face providing access to the treating chamber, a molded dish holder slidable relative to the tub through the open face between a loading position and a treating position, and an insert-molded light source provided with the dish holder for illuminating dishes contained in the dish holder.

DESCRIPTION OF EMBODIMENTS OF THE INVENTION

Figure 1:
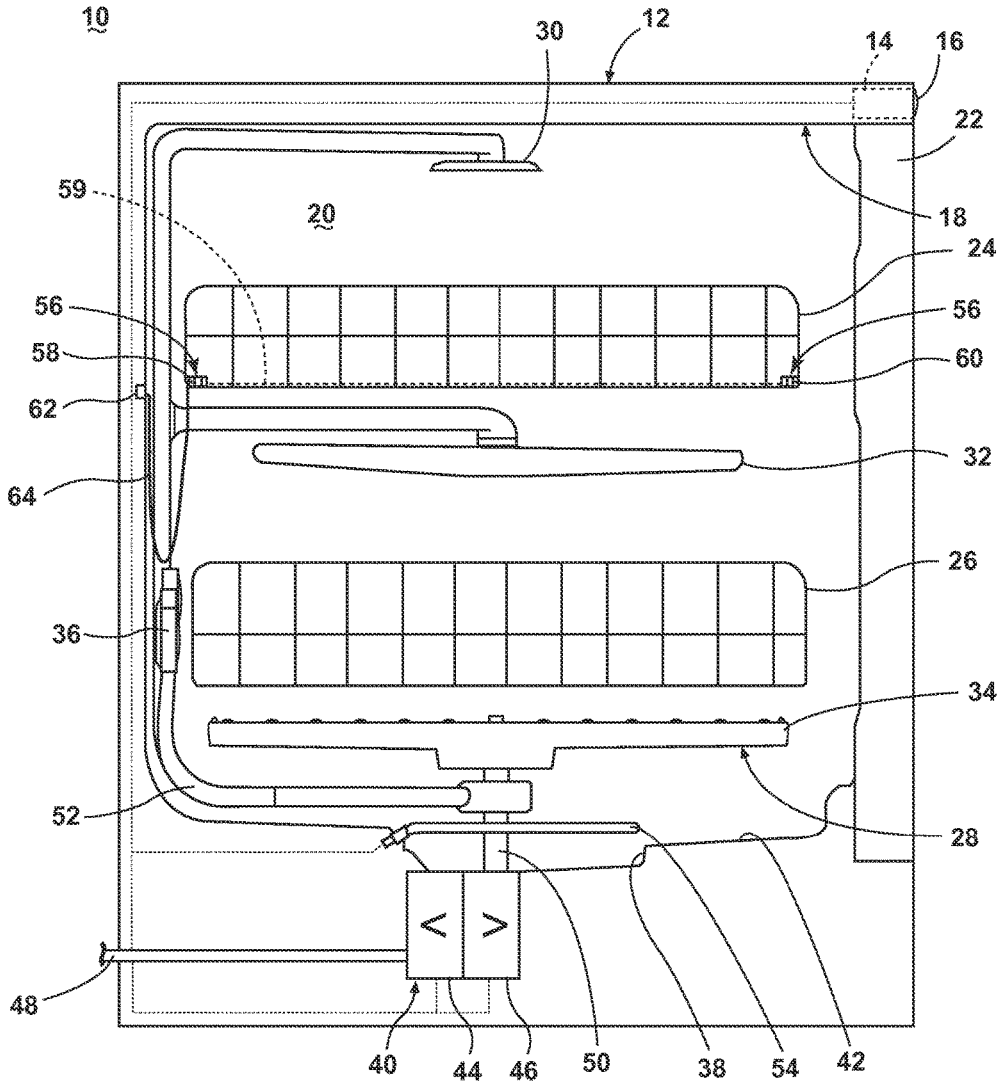
FIG. 1 is a schematic view of a dishwasher according to an embodiment of the invention.

Referring to FIG. 1, an automatic dishwasher 10 having a cabinet 12 defining an interior is illustrated. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

Figure 3:
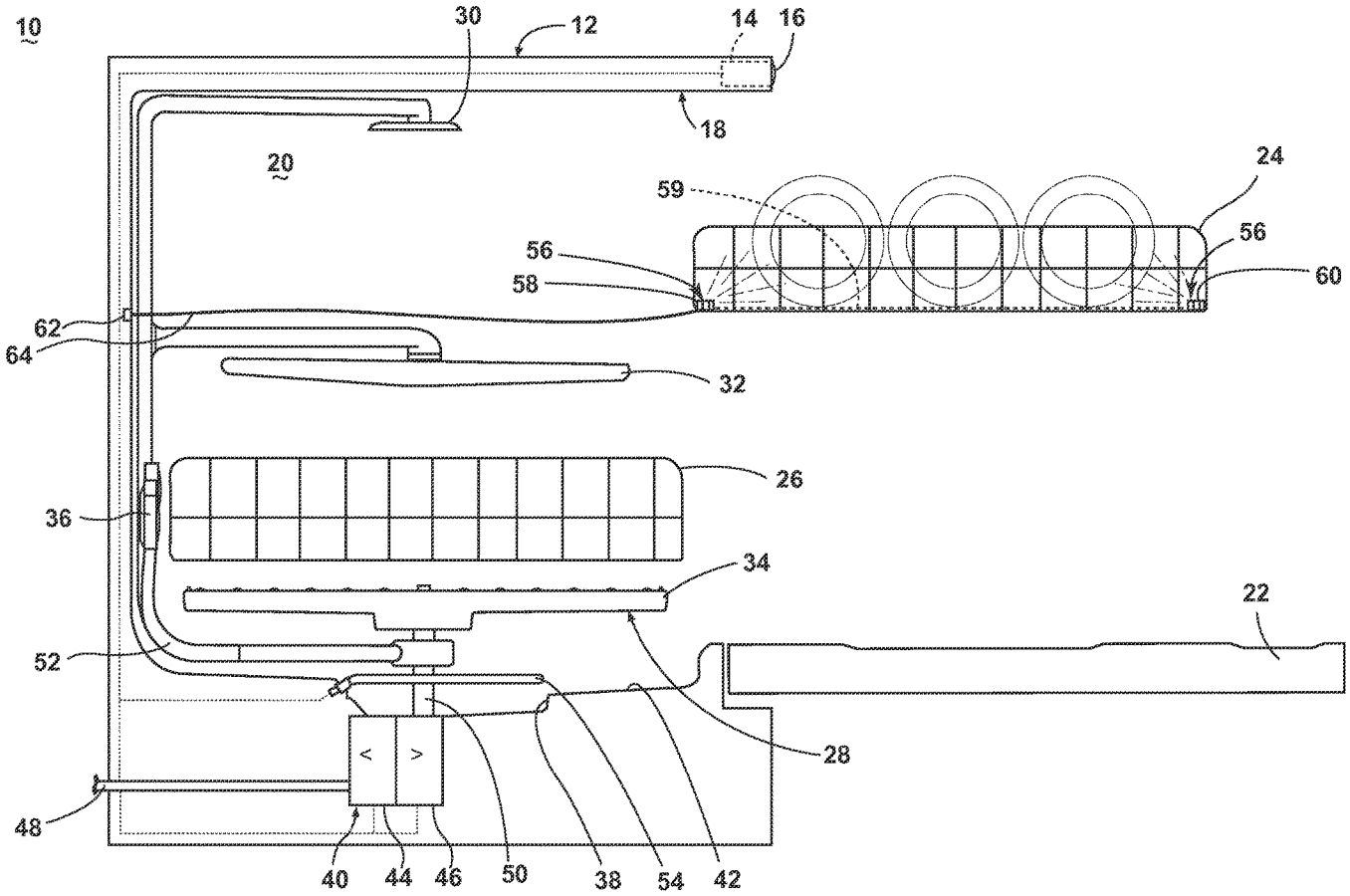
FIG. 3 is a schematic view of the dishwasher of FIG. 1 with a dish holder in a load position.

A tub 18 is located within the cabinet 12 and at least partially defines a treating chamber 20 with an access opening in the form of an open face. A cover, illustrated as a door 22, may be hingedly mounted to the cabinet 12 and may move between a closed position, as shown in FIG. 1, wherein the door 22 covers or closes the open face of the treating chamber 20 and an opened position (FIG. 3), wherein the user may access the treating chamber 20.

Dish holders have been illustrated in the form of upper and lower racks 24, 26. The upper and lower racks 24, 26 may be located within the treating chamber 20 and receive dishes for being treated. The upper and lower racks 24, 26 are mounted for slidable movement in and out of the treating chamber 20 for ease of loading and unloading. The upper and lower racks 24, 26 may be slidable relative to the tub 18 through the open face between a loading position and a treating position. As used in this description, the term "dish(es)" is intended to be generic to any item, single or plural, that may be treated in the dishwasher 10, including, without limitation; utensils, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any dishes positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

A light source 56 may be provided on one or both of the upper and lower racks 24, 26 for illuminating dishes contained therein. In the illustrated example, a light source 56 has been illustrated in the upper rack 24 only for clarity purposes. However, each of the upper and lower dish racks 24, 26 may have a corresponding light source provided thereon for illuminating dishes contained in each of the of the upper and lower dish racks 24, 26, respectively. The light source 56 may include a plurality of light sources including that the plurality of light sources may include light emitting diodes (LEDs). In the illustrated example, the light source 56 includes a first light source 58 and a second light source 60. The first and second light sources 58 and 60 may be operably coupled through a wired connection 59. Both of the first light source 58 and the second light source 60 have been illustrated as including several LEDs. It will be understood that the light source 56 may include any suitable light source and that any number of light sources may be provided on the upper rack 24 in any suitable location. Regardless of which of the upper and lower racks 24, 26 the light source(s) 56 are on, the light source(s) 56 may be oriented to initially upwardly direct at least a portion of the light emitted by the light source(s) 56. This may cause the dishes in the upper rack 24 and/or lower rack 26 to be illuminated while directing light away from the bottom of the tub 18, which may become dirty with use.

A power source 62 may be coupled to the light source 56 by an electrical conductor such as a wire connection 64. The power source 62 has been illustrated as being located exteriorly of the tub 18 and the wire connection 64 has been illustrated as passing through the tub 18 and into the treating chamber 20, although the wire connection need not pass through the tub 18. Alternatively, the power source 62 may be located inside the tub 18. It is contemplated that the power source 62 may be a self-contained power source or that it may be wired or wirelessly connected to a main power source. For example, if the power source 62 is located within the tub 18 it may be inductively coupled to a power source located out of the tub 18. Alternatively, the power source 62 may be entirely self-contained. For example, if the power source 62 is located within the tub 18, it may include a battery pack, a flywheel, or a capacitor.

Regardless of whether the power source 62 is located inside the tub 18 or outside the tub 18, the wire connection 64 may be provided with slack to enable the upper rack 24 to move at least partially out of the treating chamber 20, such as to the loading position. Where light sources 56 are located on both the upper rack 24 and the lower rack 26, the light sources 56 may be operably coupled to a single power source 62 by separate wire connections, each provided with slack to enable the upper and lower dish racks 24, 26 to move at least partially out of the treating chamber 20. Alternatively, the light sources 56 may be operably coupled to multiple power sources 62 by slack wire connections 64.

Figure 2:
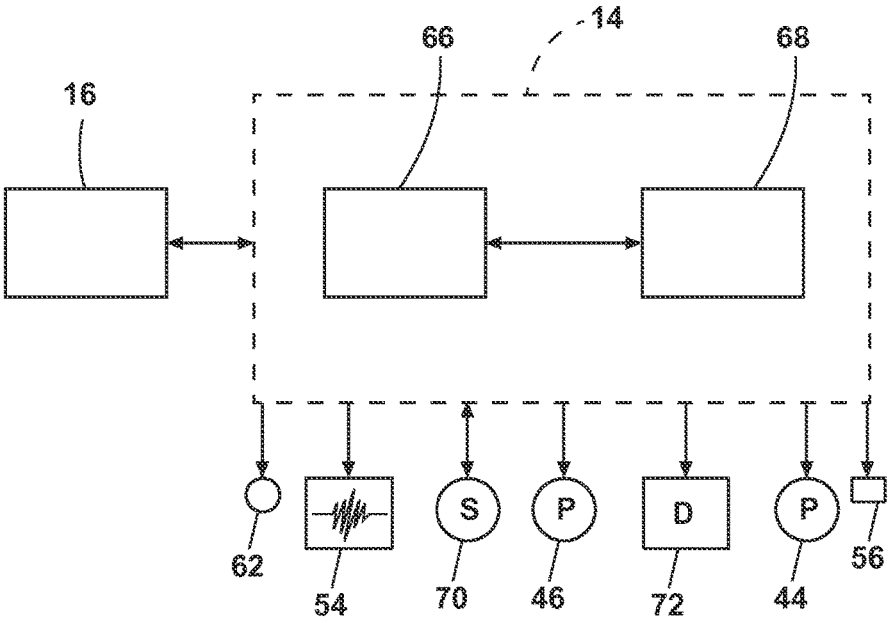
FIG. 2 is a schematic view of a control system of the dishwasher of FIG. 1.

As illustrated in FIG. 2, the controller 14 may be provided with a memory 66 and a central processing unit (CPU) 68. The memory 66 may be used for storing control software that may be executed by the CPU 68 in completing a cycle of operation using the dishwasher 10 and any additional software. For example, the memory 66 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 14 may be operably coupled with one or more components of the dishwasher 10 for communicating with and controlling the operation of the components to complete a cycle of operation. For example, the controller 14 may be coupled with the recirculation pump 46 for circulation of liquid in the tub 18 and the drain pump 44 for drainage of liquid in the tub 18. The controller 14 may also be operably coupled to the heater 54 and one or more optional sensors 70. Non-limiting examples of optional sensors 70 that may be communicably coupled with the controller 14 include a moisture sensor, a door sensor, a temperature sensor, a detergent and rinse aid presence/type sensor(s). The controller 14 may also be coupled to a dispenser 72, which may dispense a detergent during the wash step of the cycle of operation or a rinse aid during the rinse step of the cycle of operation. Further, the controller 14 may be operably coupled with the power source 62 or the light source(s) 56 although this need not be the case.

During a wash and rinse portion of a cycle of operation of the dishwasher 10, the door 22 is in a closed position, and the upper and lower racks 24, 26 are disposed within the treating chamber 20 in a use position, illustrated in FIG. 1, where they are exposed to washing fluid, such as water, and wash aids, such as detergents and rinse aids. When the dishwasher 10 is not in a portion of the cycle of operation, the user may move the door 22 to an open position and may move the upper and lower racks 24, 26 from the treating chamber 20 to a load position where at least a portion of the racks 24, 26 resides exteriorly of the cabinet 12 and where the upper and lower racks 24, 26 may be emptied or filled. The load position is partially illustrated in FIG. 3, which shows the door 22 in the open position and the upper rack 24 in the load position; the lower rack 26 remains in the use position. As illustrated, the wire connection 64 becomes more taunt as the upper rack 24 is moved to the load position. The light sources 56 are illustrated as initially directing light towards dishes in the upper rack 24.

Figure 4:
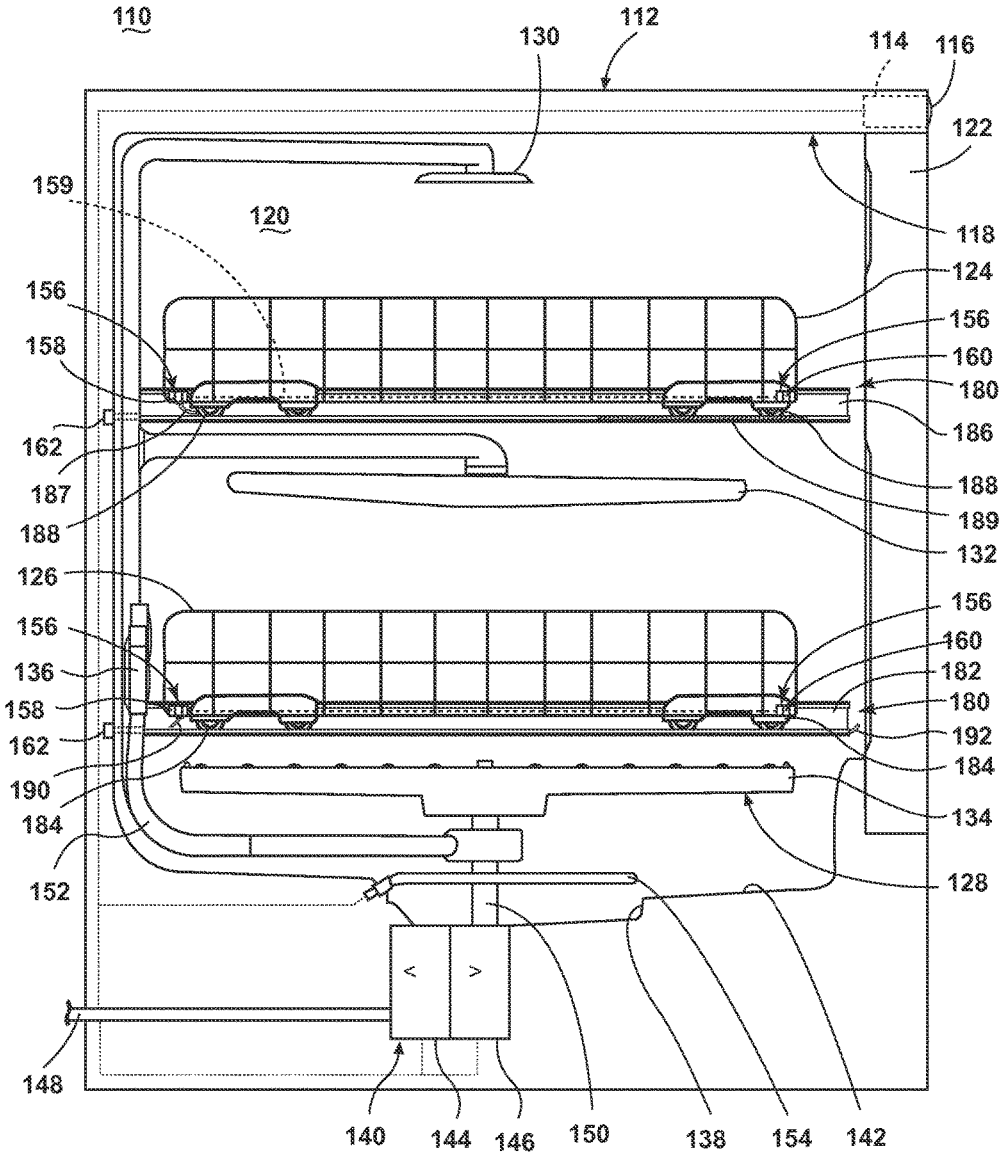
FIG. 4 is a schematic view of a dishwasher with a dish holder having drawer slides.

FIG. 4 illustrates a second embodiment of the dishwasher 110, with an alternative light source 156/power source 162 configuration. The second embodiment is similar to the first embodiment as illustrated in FIG. 1. Therefore, like parts will be identified with like numerals increased by 100, with it being understood that the description of the like parts of the first embodiment applies to the second embodiment, unless otherwise noted.

In the illustrated example, the upper and lower racks 124, 126 are slidably mounted to the tub 118 by a rail system 180. For the lower rack 126, the rail system 180 may include a pair of rails 182 formed on side walls of the tub 118 in alignment with the inner surface of the door 122 when the door 122 is in the open position such that the lower rack 126 may be moved out of the treating chamber 120 over the door 122. The lower rack 126 may be provided with wheels 184 which roll along the rails 182 and allow the lower rack 126 to be rolled out at least partially onto the inner face of the open door 122 and into the load position.

The rail system 180 for the upper rack 124 may be slightly more complex and may include a set of rails 186 on which the upper rack 124 may be movably supported and which in turn may be movably supported on the side walls of the tub 118. The set of rails 186 may be positioned and capable of horizontal movement by support rollers (not shown) on the side wall of the tub 118. The upper rack 124 has on each side at least two projecting rollers 188 that operably couple with the set of rails 186 and allow the upper rack 124 to slide freely along the set of rails 186. Thus, the upper rack 124 may roll along the set of rails 186 as the set of rails 186 rolls along the supporting rollers (not shown) so that the upper rack 124 may slide far enough with the set of rails 186 to move completely out of the treating chamber 120.

The rail system 180 facilitates movement of the upper and lower racks 124, 126 along a path of travel between the use and load positions. While the rail system 180 permits the complete extension of the upper and lower racks 124, 126 beyond the tub 118, other rail systems may not. Any suitable rail system may be utilized and the rail system 180 described herein is merely for exemplary purposes. It has been contemplated that any other type of slides or rail system or any other mechanism suitable for slidably coupling the dish holders to the tub 118 and facilitating movement of the dish holders between the use and load positions may be utilized.

As with the earlier embodiment at least one light source 156 is provided in the dishwasher 110. In the illustrated example, light sources 156 have been illustrated as being provided on each of the upper and lower racks 124, 126 for illuminating dishes contained in the upper and lower racks 124, 126, respectively. In the illustrated example, a power source 162 may be selectively coupled to the light source(s) 156 by a contact connection 181 (FIG. 5A and FIG. 5B) provided on the rail system 180. The contact connection 181 may be closed to couple the power source 162 to the light source 156 when the upper and lower racks 124, 126 are slid at least partially out of the treating chamber 120.

With respect to the light source 156 on the upper rack 124, the contact connection 181 includes at least a portion of the rail 186 of the rail system 180 and a roller 188 of the rail system 180. The light source 156 on the upper rack 124 may be operably coupled to the roller 188 of the rail system 180 such as through a connection 187. The power source 162 is operably coupled, directly, such as wired, or indirectly, such as wireless, including a capacitive coupling, to the rail 186 of the rail system 180. As with the earlier embodiment, the power source 162 has been illustrated as being located exteriorly of the tub 118. Alternatively, the power source 162 may be located inside the tub 118. It is contemplated that the rail 186 may be directly or indirectly coupled, such as through induction, with the power source 162.

Figure 5A:
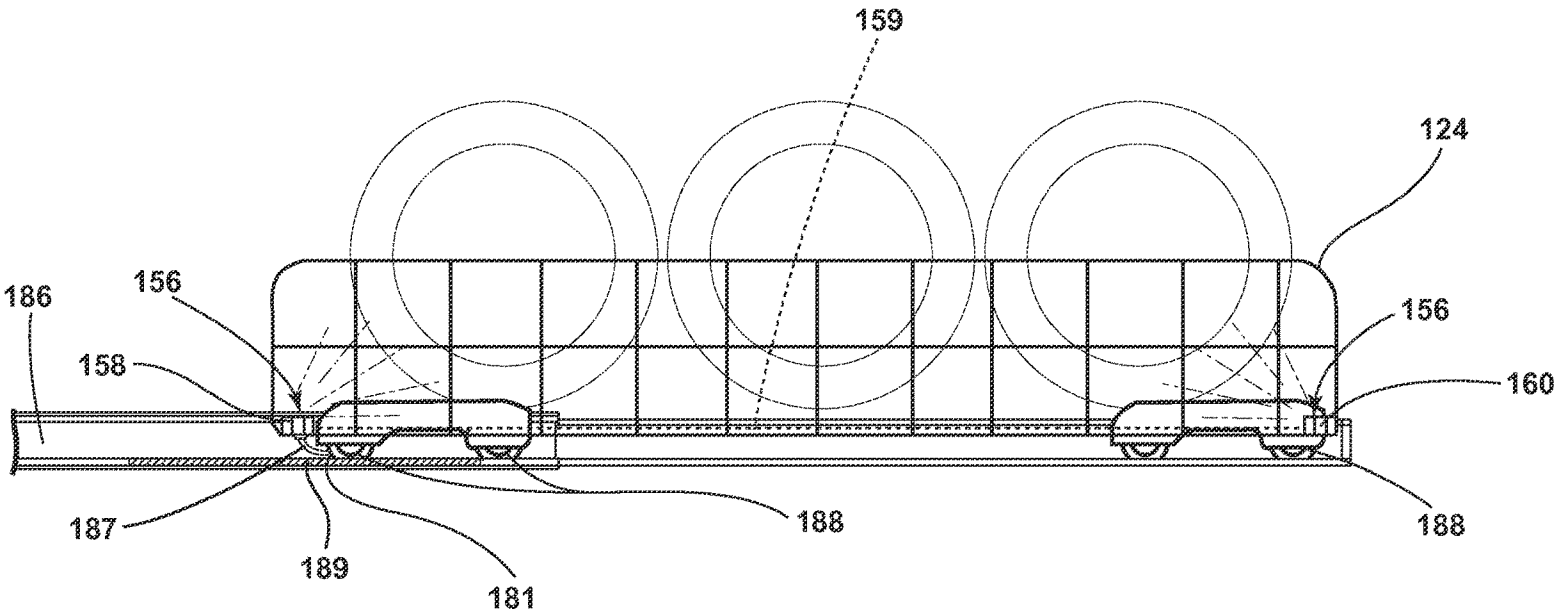
FIG. 5A is a schematic view of a portion of the dishwasher of FIG. 4 with a dish holder in a load position.

As the roller 188 makes contact with the rail 186 the contact connection 181 may be formed and the light source 156 may be illuminated. So long as the roller 188 and the rail 186 are in contact the contact connection 181 may be closed to couple the power source 162 to the light source 156 including when the upper rack 124 is slid out of the treating chamber 120, as shown in FIG. 5A. The rail 186 and the roller 188 may also be formed such that the contact connection 181 is only closed when the upper rack 124 is at least partially out of the treating chamber 120. For example, a portion of the rail 186 may be insulated so that the contact connection 181 is not closed when the upper rack 124 is located inside the treating chamber 120. In such an instance a conductive portion 189 of the rail 186 would make a contact connection 181 with the roller 188 when the upper rack 124 is slid out of the treating chamber 120.

Figure 5B:
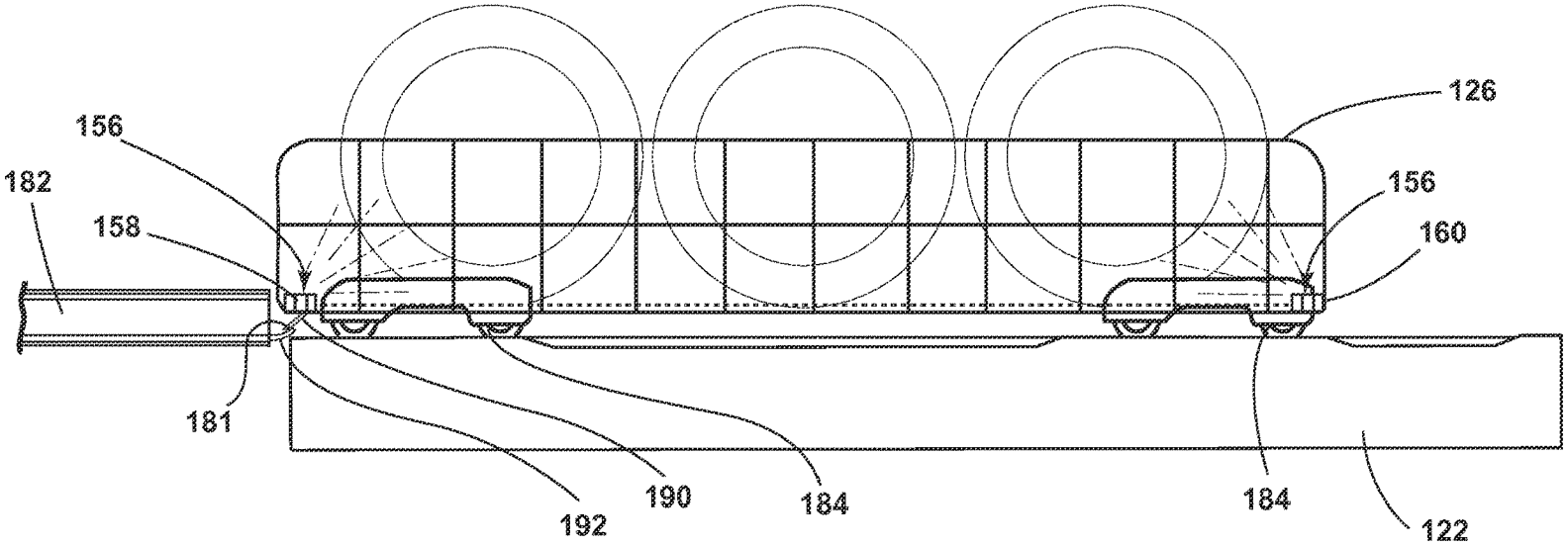
FIG. 5B is a schematic view of another portion of the dishwasher of FIG. 4 with a dish holder in a load position.

With respect to the lower rack 126, as illustrated in FIG. 5B the contact connection 181 includes a spring finger 190 that extends from the lower rack 126 and is operably coupled with the light source 156. The spring finger 190 of the contact connection 181 may be in contact with a portion of the contact connection 181 provided on the rail system 180, such as a portion 192 of the rail 182, when the lower rack 126 is in the loading position, as shown in FIG. 5. In this manner, the contact connection 181 is closed when the lower rack 126 is in the loading position.

Where light sources 156 are located on both the upper rack 124 and the lower rack 126, the light sources 156 may be operably coupled to multiple power sources 162 as illustrated or may be coupled to a single power source 162 by contact connections 181 provided on the rail system 180 for each of the upper and lower dish racks 124, 126.

Figure 6:
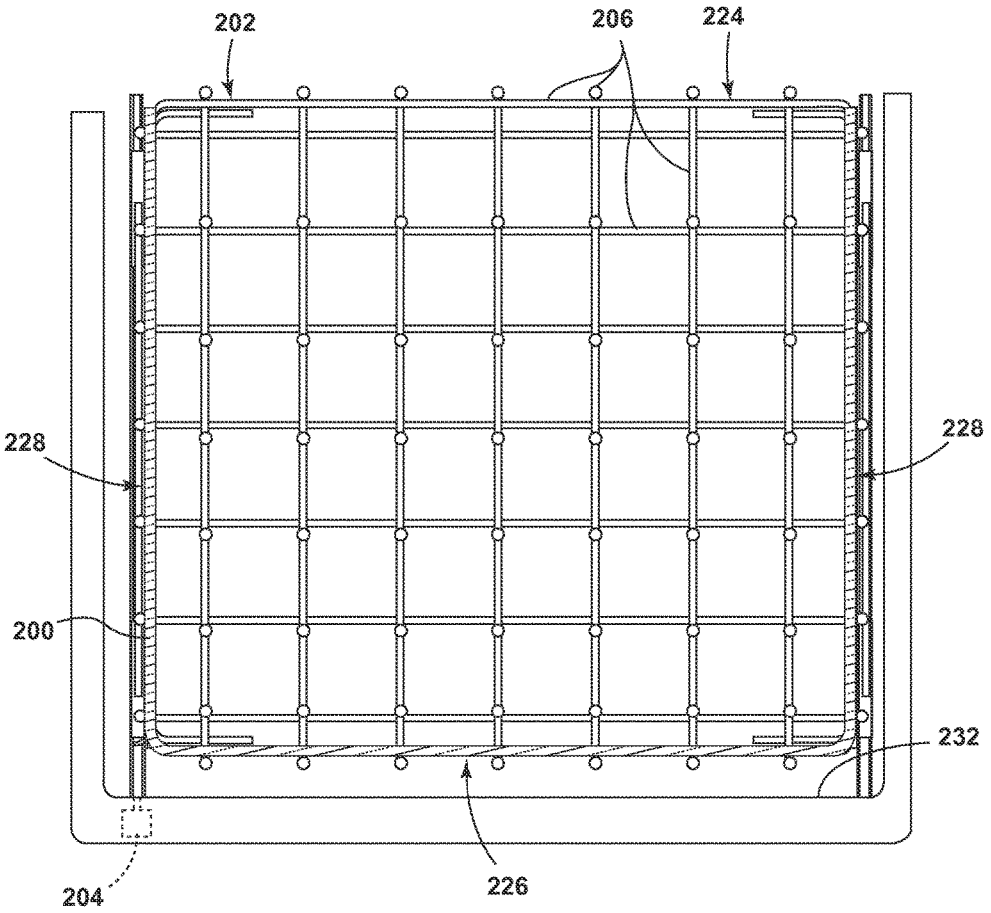
FIG. 6 is a top view of an exemplary rack for use with one of the dishwashers in FIGS. 1 and 4.

In both of the above illustrated examples, it is contemplated that the light source(s) may be provided on the upper and lower racks in any suitable manner including that the light source(s) may be attached to the upper and lower racks or may be integrated with the upper and lower racks. For example, the light source may be in the form of a light pipe that is integrated with the rack and forms a portion of one of the racks. For example, FIG. 6 illustrates that the light source is a light pipe 200 integrated in a dish rack 202. In the dish rack 202 a portion of the dish rack 202 could be formed from the light pipe 200 instead of one of the coated wire elements 206 forming the traditional wire frame rack. In the illustrated example, the light pipe 200 forms a portion of the topmost wire element of the wire frame rack. The dish rack 202 has four sides, including a front side 224 and a back side 226 joined by two lateral sides 228. In the illustrated example, the light pipe 200 extends along the back and lateral sides 226, 228 of the dish rack 202. Instead of a single light pipe 200 several light pipes may be used. The light pipe 200 may be operably coupled with a power source 204, which may be inside or outside the tub 232 including by way of one of the above examples. Alternatively, the light pipe 200 may be operably coupled with a battery or other mechanism located near the light pipe 200 on the dish rack 202.

Figure 7:
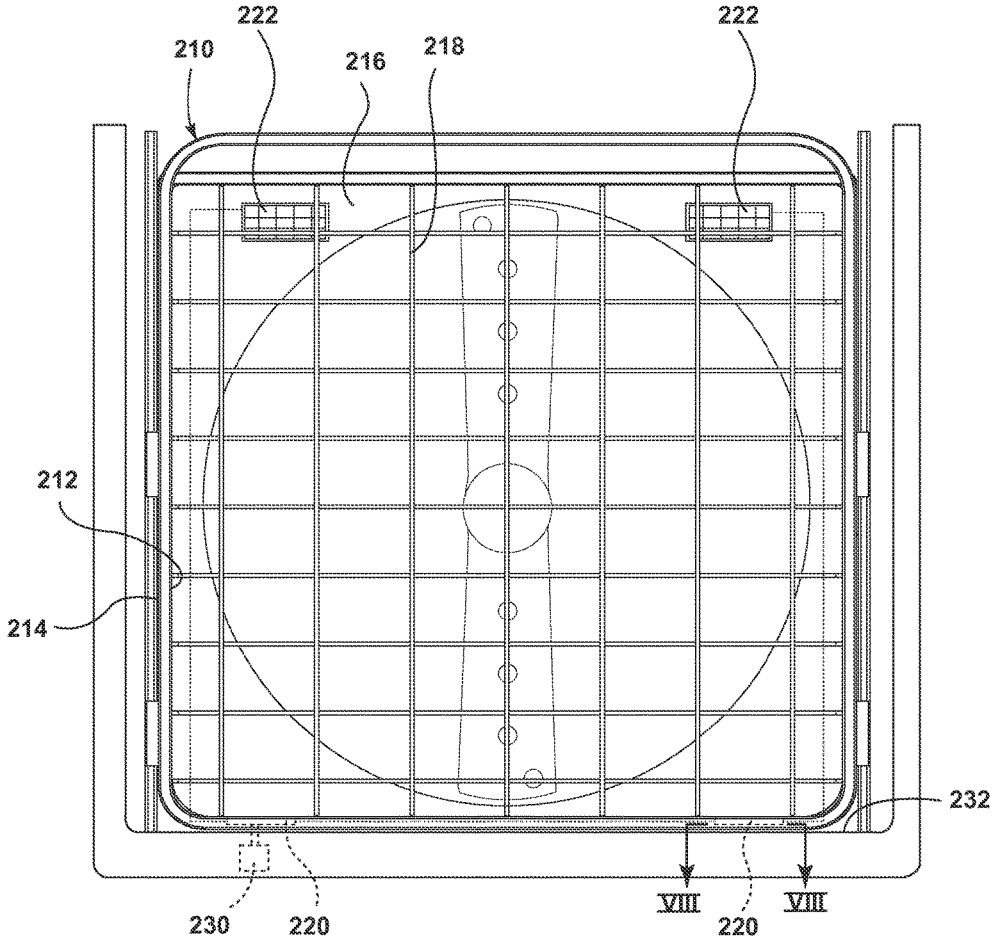
FIG. 7 is a top view of an exemplary drawer for use with one of the dishwashers in FIGS. 1 and 4.
Figure 8:
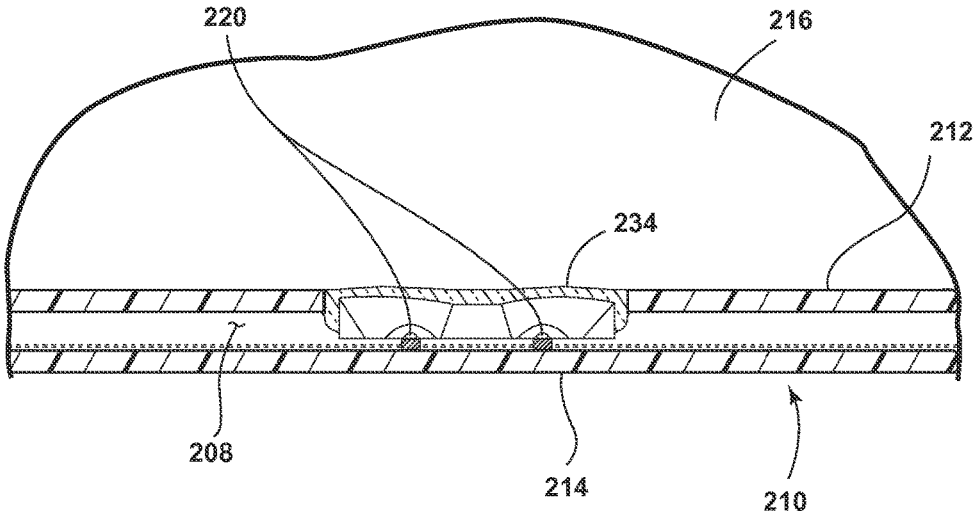
FIG. 8 is a cross-sectional view of the drawer of FIG. 7.

Furthermore, the dishwashers above may include drawers instead of dish racks. In models that have a drawer, the light source could be integrated into portions of the drawer. In such an instance the light source may be either insert-molded or attached separately to the portions of the drawer. When using an insert-molded light source, the drawer is molded as well. For example, FIG. 7 illustrates that dish holder may be in the form of a drawer 210. The drawer 210 may include an inner wall 212 spaced from an outer wall 214, a pan 216 may form a portion of the bottom of the drawer 210 and a rack 218 may be positioned within the drawer 210. A light source 220 may be molded to fit in the cavity 208 between the inner wall 212 and the outer wall 214 of the drawer 210. Further, a light source 222 may be provided on the pan 216. The light sources 220 and 222 may be operably coupled with a power source 230, which may be inside or outside the tub 232 including by way of one of the above examples. Alternatively, the light sources 220 and 222 may be operably coupled with a battery or other mechanism located on the drawer 210. The cross-sectional view illustrated in FIG. 8 better illustrates the position of the light source 220 in the cavity 208 between the inner wall 212 and the outer wall 214 of the drawer 210. The light source 220 may form a portion of the inner wall 212 or may be placed behind a transparent section 234 of the inner wall 212 so that light may be directed towards dishes in the rack 218.

Furthermore, any of the dishwashers described above may include a light source in the form of multi-colored LEDs. The LEDs may automatically change color to indicate a status of the dishwasher to the user. For example, the color may indicate the cleanliness of the dishes loaded into the dishwasher. Before a cycle of operation is started, a user may open the door one or more times to load dishes into the treating chamber. Each time the user opens the door the LEDs may emit a first color, such as red, to indicate that a cycle of operation has not been run and that the dishes are dirty. After a cycle of operation has been run, when the user opens the door, the LEDs may emit a second color, such as blue or white, to indicate that the cycle of operation is complete and that the dishes are clean. In another implementation, the color emitted by the LEDs may be manually controllable or settable by the user according to the user's preference. The user may be able to set the color of light emitted by the LEDs via the user interface.

Currently, lights mounted in dishwashers create a path for leakage from the dishwasher and are positioned to light areas of the tub, rather than specifically lighting the dishes. Also, lights on the tub can collect food soil. There are several advantages of the present disclosure arising from the various features of the apparatuses described herein. For example, the embodiments described above allow for dishes in the dish holders to be illuminated regardless of the position of the dish holder. The embodiments described above also allow for various ways to power light sources provided on the dish holders. Further, integration of the lights into dish holders may eliminate the need for separate assemblies, which are mounted on the tub that can collect food soils or make leak paths. Further, providing light sources in the dish holders leaves more capacity space in the tub for dishes.

While the invention has been specifically described in connection with certain specific embodiments thereof, it is to be understood that this is by way of illustration and not of limitation. The patentable scope of the invention is defined by the claims, and may include other examples that occur to those skilled in the art. It will be understood that any features of the above described embodiments may be combined in any manner. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, comprising:

a tub at least partially defining a treating chamber for receiving dishes for treatment according to the cycle of operation and having an open face providing access to the treating chamber;

a dish holder slidable relative to the tub through the open face between a loading position and a treating position;

a rail system slidably coupling the dish holder to the tub for movement relative to the treating chamber;

a light source provided on the dish holder for illuminating dishes contained in the dish holder; and a power source selectively coupled to the light source by a contact connection wherein a first portion of the contact connection is provided on the rail system and a second portion of the contact connection includes a spring finger that extends from the dish holder and is operably coupled with the light source where the contact connection is configured to be closed to couple the power source to the light source when the dish holder is slid at least partially out of the treating chamber.

2. The dishwasher of claim 1 wherein the light source includes a plurality of light sources.

3. The dishwasher of claim 2 wherein the plurality of light sources comprise light emitting diodes.

4. The dishwasher of claim 1 wherein the power source is located exteriorly of the tub.

5. The dishwasher of claim 1 wherein the dish holder comprises a drawer having a pan and the light source is provided on the pan.

6. The dishwasher of claim 1 wherein the contact connection further comprises a rail of the rail system and a roller of the rail system.

7. The dishwasher of claim 6 wherein the light source is operably coupled to the roller of the rail system and the power source is operably coupled to the rail of the rail system.

8. The dishwasher of claim 1 wherein the spring finger is in contact with a portion of the contact connection provided on the rail system when the dish holder is in the loading position.

9. The dishwasher of claim 1 wherein the dish holder comprises a dish rack and the light source is provided on the dish rack.

10. The dishwasher of claim 9 wherein the dish rack comprises upper and lower dish racks and each of the upper and lower dish racks has a corresponding light source provided thereon for illuminating dishes contained in each of the of the upper and lower dish racks, respectively.

11. The dishwasher of claim 10 wherein the light sources are operably coupled to multiple power sources by contact connections provided on the rail system for the upper and lower dish racks.

12. The dishwasher of claim 1 wherein the light source is directed away from a bottom of the tub.

13. The dishwasher of claim 1 wherein the dish holder comprises a drawer.

14. The dishwasher of claim 13 wherein the drawer comprises an outer wall and an inner wall spaced from the outer wall to define a cavity, and the light source is molded to fit in the cavity.

* * * * *